United States Patent [19]

DeMato

[11] Patent Number: 4,474,290

[45] Date of Patent: Oct. 2, 1984

[54] MUSICAL INSTRUMENT CASE AND HOLDER

[76] Inventor: Joseph J. DeMato, 1505 Granville St., Lynchburg, Va. 24502

[21] Appl. No.: 548,406

[22] Filed: Nov. 3, 1983

[51] Int. Cl.[3] ..... A45C 11/00; B65D 85/54

[52] U.S. Cl. ..... 206/314; 206/45.23; 206/14

[58] Field of Search ..... 206/314, 45.23, 14, 206/45.6, 45.13; 84/DIG. 17, 45.3; 248/443, 453, 461

[56] References Cited

U.S. PATENT DOCUMENTS

| | | | |
|---|---|---|---|
| 973,500 | 10/1910 | Gunther | 206/314 |
| 2,372,845 | 4/1945 | Nelson | 206/314 |
| 3,637,070 | 1/1972 | Friedman | 206/314 |
| 3,756,114 | 9/1973 | Bontempi | 206/314 |
| 3,901,384 | 8/1975 | Lee et al. | 206/314 |
| 4,126,222 | 11/1978 | Aust | 206/326 |
| 4,147,254 | 4/1979 | Bruce | 206/314 |
| 4,223,785 | 9/1980 | Jacques | 206/314 |
| 4,345,732 | 8/1982 | Gallegos | 206/314 |

*Primary Examiner*—Joseph Man-Fu Moy

*Attorney, Agent, or Firm*—Kerkam, Stowell, Kondracki & Clarke

[57] ABSTRACT

A guitar case and holder combination is provided which can be fixed by an auxilliary support member into a partially opened position enough to allow the case to stand upright and act as a holder for the guitar by means of a slanted and indented surface provided on one of the sides thereof.

7 Claims, 4 Drawing Figures

MUSICAL INSTRUMENT CASE AND HOLDER

BACKGROUND OF THE INVENTION

Stringed instruments such as guitars, violins and the like which are commonly hand held are normally stored in a hand-carrying case until needed for use. At such time the instrument is taken from the case and usually placed on a separate stand, or in those situations where the case itself is used as a stand or holder, the case is opened or extended to a fully opened or a substantially opened position in order that the case may stand in an upright position. In other situations the case may be provided with elaborate and complex moving parts involving additional hinged surfaces than what are normally provided for such cases in order to convert the case into an instrument holder. The need thus arises for a conventional case for such an instrument having no more than the requisite conventional parts, such as a bottom and top hinged together in the conventional position, to be used as an instrument holder in which, further, such cases need not by fully extended to an open position in order to stand upright and not take up any more space than what would be required for a closed case in an upright position. Such needs arise, naturally, in crowded circumstances under the actual conditions of musical performance on stage. In such situations it is difficult or impossible to either lay a case flat or extend it in a fully opened position, either upright or on its side.

SUMMARY OF THE INVENTION

According to the principles of the invention there is provided a simplified construction of a case and holder combination for a stringed instrument, such as a guitar including acoustical guitars, spanish guitars, flat-top guitars, six and twelve string guitars, concert guitars, large body guitars and electric and solid body guitars. The case according to the invention is so designed that after removal of the instrument an instrument neck holder member or auxiliary support is placed in keyhole slots provided on the exterior of the case near the top thereof which thus secures the case in a partially, that is, slightly opened position. In the partially opened position the case is then enabled to stand upright, supported solely by its bottom end face. The back of the instrument can then be placed on an inclined and indented surface of the case itself provided for this purpose on one side of the case with the bottom part of the instrument supported by a correspondingly contoured surface defining the indented portion of the case.

These and other objects of the invention will become apparent from a further study of the specification and accompanying drawings in which:

FIG. 1 is a perspective view of the case according to the invention showing the instrument and neck holder therefor received therein, FIG. 2 is a side view of the case, with the instrument neck holder shown positioned for operative use, FIG. 3 is a front view of the case shown in FIG. 2, and FIG. 4 is a detailed view of the pin and slot configuration between the case and neck holder.

DETAILED DESCRIPTION

Figure 1:
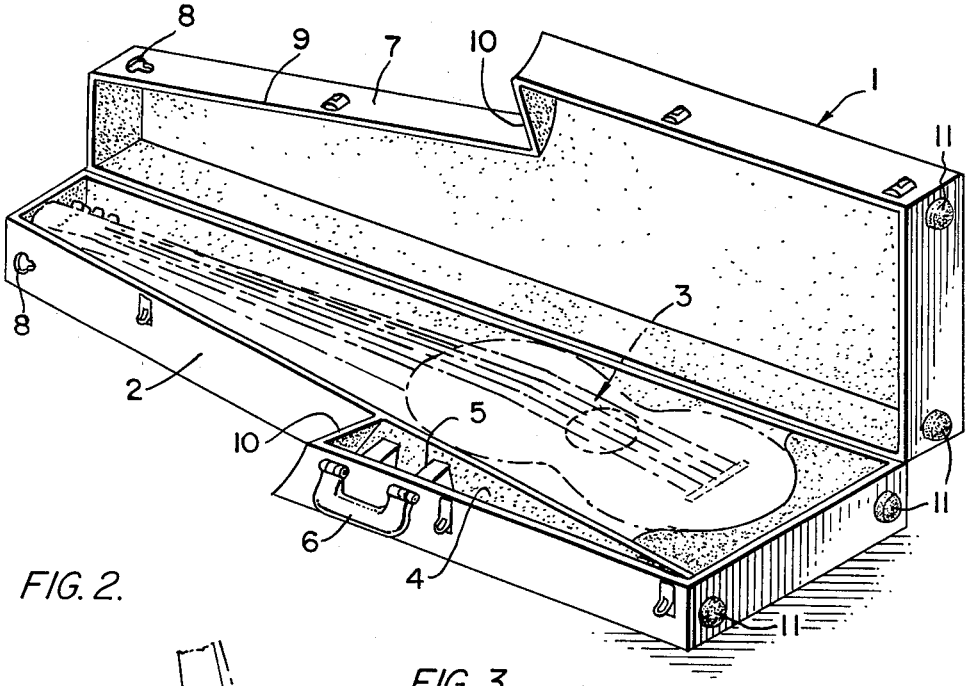

Referring now to FIG. 1 there is shown generally a case 1 constructed according to the principle of the present invention having a bottom portion 2 for receiving a guitar instrument 3 and an instrument auxiliary support storage space 4 for receiving a neck-holder auxilliary support member 5. A suitable handle 6 is pivotally provided on the side of the bottom portion, as shown. Hinged to the straight long side of the bottom portion, as by suitable hinge members is a top portion 7 of the case which is generally shallower than the bottom portion but need not necessarily be so. Suitable latch members of conventional design are supplied at corresponding spaced locations along the irregular sides of the respective bottom and top portions, as shown, for securing the case in a closed position. As shown near the end portions of the bottom and top irregular sides, respectively, are slot holes 8 for receiving the respective pin members of the auxilliary support 5, to be more fully described below.

Figure 2:
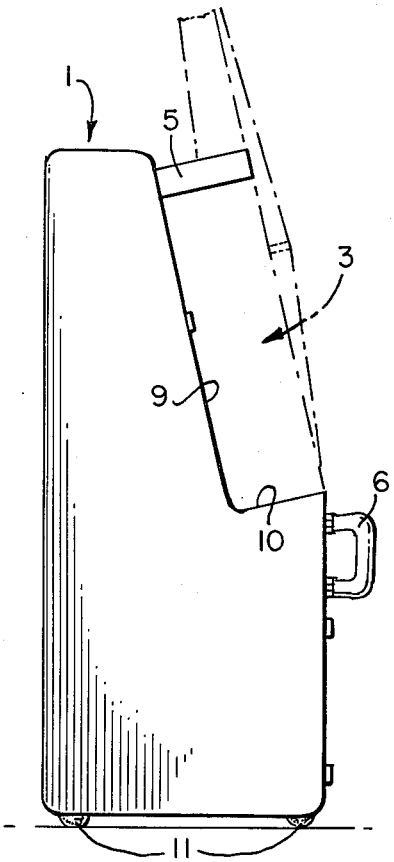

FIG. 2 shows the case 1 in its upright instrument holder position with the neck holder 5 secured to the upper end portion of the irregular side of the case. This side comprises an inclined and indented portion 9 having a bottom surface 10 for supporting the bottom of the instrument 3, shown in dotted line; the back of the instrument is seen to rest against the inclined surface 9 while the neck thereof extends through the neck holder 5.

Figure 3:
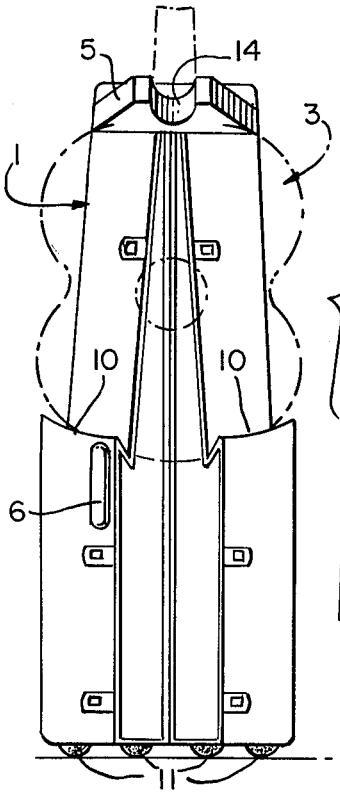

As will be seen from FIG. 3, the bottom support surface 10 is contoured to support the corresponding contoured surface of the instrument 3. Also, the auxilliary support 5 is shown positioned in the upper part of the case so that its positioning defines a partially opened condition for the case 1 which then can stand solely on its bottom surface to which suitable feet members 11 are provided for this purpose.

Figure 4:
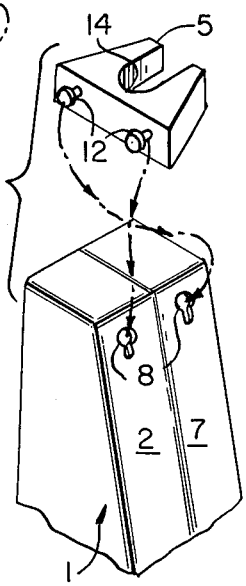

FIG. 4 shows in detail the auxilliary support 5 having a U-shaped neck portion 14 and spaced apart pin members 12 comprising a flat head portion of a larger diameter than the shank portion for facilitating a bayonet-like locking engagement with the slotted holes 8 in the bottom and top portions respectively of the case 1. When the auxilliary support 5 is secured to the upper portion of the case as shown in FIG. 2 and 3, the case cannot be further opened or closed but is fixed in its partially opened position for proper support in an upright position. In this way the case when used as a stand or instrument holder according to the invention does not take up an inordinate amount of space, as for example a case which needs to be fully opened in order to stand in an upright position or in such situations as when a case must be laid flat on its side to act as an instrument holder.

The case and holder combination, according to the invention, can be constructed from suitable materials, such as plastic, fiberglass, particle-board, plywood, masonite, wood or any other formable or moldable material. Also it may be stamped or formed from metals or alloys comprising aluminum and/or steel. The areas of the case, including the auxilliary support, which contact the instrument can be suitably lined with foam rubber, felt, or spongy material that is non-scratching. Further, velcro strips or foam rubber inserts can be provided as needed for the particular shape of the instrument 3 as well as the auxilliary support 5 when stored in the case.

The foregoing relates to a preferred exemplary embodiment of the invention, it being understood that other variants and embodiments thereof are possible within the spirit and scope of the invention, the latter being defined by the appended claims.

What is claimed and desired to be secured by letters patent of the U.S. is:

1. A case and stand combination for a stringed instrument comprising, a generally rectangular shaped bottom receptacle for receiving said instrument, a similarly shaped top portion hinged along one side of said bottom receptacle for closing thereon, said bottom and top forming together a stand for said instrument when defining a partially opened position for said case and supported on a surface thereof adjacent said hinged sides, and a portion of the sides of said bottom and top opposite and parallel to said hinged sides being slanted and indented from the long axis thereof for forming a support for said instrument in a rest position.

2. A case and stand combination according to claim 1, further comprising an auxilliary support member removably positioned near one end of said support for securing the neck portion of said instrument.

3. A case and stand combination according to claim 2, wherein said auxilliary support is generally U-shaped and is provided with spaced prong members for being removably inserted into corresponding slots in said support, whereby the spacing between said slots and said corresponding prong members determines said partially opened position for said case.

4. A case and stand combination according to claim 1, wherein a handle is provided on said bottom portion adjacent said slanted and indented portion and closure means are provided between said top and bottom on said slanted and indented portion and the remaining portion of the sides opposite to said hinged sides.

5. A case and stand combination according to claim 1, wherein feet members are provided on said surface adjacent said hinged sides.

6. A case and stand combination according to claim 2, wherein said bottom receptacle is provided with an interior spaced portion for receiving said auxilliary support in addition to receiving said instrument.

7. A case and stand combination according to claim 1, wherein said support comprises a contoured surface corresponding to a contoured surface of said instrument.

* * * * *